US009644439B2

(12) United States Patent
Lambert et al.

(10) Patent No.: US 9,644,439 B2
(45) Date of Patent: May 9, 2017

(54) CORE BARREL HEAD ASSEMBLY

(75) Inventors: Paul Lambert, Chambly (CA); Patrick Salvador, North Bay (CA)

(73) Assignee: ATLAS COPCO CANADA INC, Dollard-des-Ormeaux, Quebec (CA)

( * ) Notice: Subject to any disclaimer, the term of this patent is extended or adjusted under 35 U.S.C. 154(b) by 459 days.

(21) Appl. No.: 14/375,094

(22) PCT Filed: Jan. 27, 2012

(86) PCT No.: PCT/CA2012/050045

§ 371 (c)(1),
(2), (4) Date: Jul. 28, 2014

(87) PCT Pub. No.: WO2013/110159

PCT Pub. Date: Aug. 1, 2013

(65) Prior Publication Data

US 2014/0353044 A1 Dec. 4, 2014

(51) Int. Cl.
*E21B 25/02* (2006.01)
*E21B 34/06* (2006.01)

(52) U.S. Cl.
CPC ..... *E21B 25/02* (2013.01); *E21B 34/06* (2013.01)

(58) Field of Classification Search
CPC ..... E21B 25/02; E21B 21/10; E21B 34/06; E21B 23/006; F16K 35/06; Y10T 137/7854
See application file for complete search history.

(56) References Cited

U.S. PATENT DOCUMENTS 4,832,138 A * 5/1989 Hallez ..... E21B 25/02 175/243
5,267,620 A * 12/1993 Lee ..... E21B 25/02 175/230

(Continued)

FOREIGN PATENT DOCUMENTS

CA 2254040 A1 5/1999

OTHER PUBLICATIONS

PCT/ISA/210—International Search Report—Oct. 26, 2012 (Issued in Application No. PCT/CA2012/050045).

(Continued)

*Primary Examiner* — Daniel P Stephenson
(74) *Attorney, Agent, or Firm* — Venable LLP; Jeffri A. Kaminski

(57) ABSTRACT

A valve assembly for use in an inner tube member of a core barrel head assembly positionable within a drill string of a drilling apparatus. The piston member of the valve assembly is located between a fluid pressure communication port and a fluid flow port to hold the retracting case in an up position and the latches retracted. After an increased fluid pressure has pushed the piston member past the annular element or bushing, the piston member substantially restricts fluid flow through the bushing and allows the retracting case to move to a down position and extend the latches. If the latches are not extended due to an obstruction or misalignment, the retracting case will prevent the piston member from completely passing through the bushing, thus maintaining high fluid pressure due to the flow ports remaining closed, and indicating to the driller that the latches have not properly latched.

15 Claims, 6 Drawing Sheets

(56) References Cited

U.S. PATENT DOCUMENTS

| | | | | |
|---|---|---|---|---|
| 5,799,742 | A * | 9/1998 | Soinski | E21B 21/10 175/236 |
| 5,992,543 | A * | 11/1999 | Soinski | E21B 21/10 175/247 |
| 6,029,758 | A | 2/2000 | Novacovicci et al. | |
| 6,708,784 | B1 * | 3/2004 | Borg | E21B 25/02 175/244 |
| 8,794,355 | B2 * | 8/2014 | Drenth | E21B 25/02 175/271 |
| 8,869,918 | B2 * | 10/2014 | Drenth | E21B 25/02 175/263 |
| 9,399,898 | B2 * | 7/2016 | Muntz | E21B 25/02 |
| 2014/0353039 | A1 * | 12/2014 | Lambert | E21B 25/02 175/57 |
| 2014/0353044 | A1 * | 12/2014 | Lambert | E21B 25/02 175/236 |
| 2015/0014065 | A1 * | 1/2015 | Lambert | E21B 25/02 175/317 |
| 2016/0017672 | A1 * | 1/2016 | Back | E21B 23/006 166/301 |
| 2016/0123101 | A1 * | 5/2016 | Attiwell | E21B 25/02 175/57 |

OTHER PUBLICATIONS

PCT/ISA/237—Written Opinion of the International Searching Authority—Oct. 26, 2012 (Issued in Application No. PCT/CA2012/050045).

* cited by examiner 50
28
127
124
126
112
142
129
118
32
12
125
100
136
120
42
134
130
40
16
20
34
35
14

CORE BARREL HEAD ASSEMBLY

CROSS-REFERENCE TO RELATED APPLICATIONS

The application is the national phase under 35 U.S.C. §371 of PCT/CA2012/050045 filed 27 Jan. 2012.

FIELD OF THE INVENTION

The present invention generally relates to core barrels. More specifically, it relates to a core barrel head assembly.

BACKGROUND OF THE INVENTION

It is known in various connections to use valves that control the supply of a fluid by being opened when they are subjected to a certain pressure from the fluid. One such application is in wire line core drilling, as will be described below.

When performing exploratory drilling to collect rock samples from depths of from several hundred to a couple of thousand meters, double core tubes are used having an inner and an outer tube. The sample is collected in the inner tube, which usually has a length of a few meters. When the inner tube is full this is usually detected by means of a manometer or the like that measures the flushing water pressure in the core tube. A retriever device suspended on a wire is lowered into the tube for retracting the inner tube with the sample, said retriever device comprising a gripping means in the form of a claw or "spearhead" arranged to engage with a gripping means arranged on/in the upper end of the inner tube. When the wire is then tautened the inner tube is disengaged from the outer tube, and the inner tube with the sample can be hoisted up. Conversely, the claw and the gripping means on the inner tube can be used to lower a new inner tube. Equipment of this type is generally known as a wire line system.

When a new inner tube is inserted it is important to be able to ascertain that the inner tube really has reached right down to the bottom of the outer tube and has assumed its correct position for drilling, before drilling is commenced. Ascertainment that the tube can no longer move, but is firmly held is generally taken as an indication that the inner tube has reached its correct position. According to known technology, therefore, the gripping means is often designed to be combined with some type of locking member that firmly locks the inner tube in relation to the outer tube when the inner tube has reached the correct position. This locking member usually consists of a hook-like device, preferably spring-loaded, a locking claw or latch that engages with recesses or shoulders arranged in the inside of the outer tube. Actual insertion of the inner tube is usually performed by the inner tube being "pumped" along inside the drill string with the aid of water. When the inner tube is firmly in place the water pressure will increase to such an extent that a valve arranged for flushing medium in the inner tube is released.

One problem with such known arrangements is that when the inner tube is inserted into the drill string it sometimes catches before it has reached the correct position for drilling. With designs currently in use, the increase in water pressure then occurring will release the flushing valve before the inner tube has reached its correct position and, in the worst case, drilling will be commenced. This primarily entails a disadvantage from the financial point of view since the drilling will be into thin air. There is also a risk of the core at the bottom being destroyed. Hence it is useful to provide a landing indicator system in order to ensure that the inner tube has reached its correct position.

The current industry standard for a core barrel landing indication valve is to use a ball or plunger to pass through a plastic bushing, causing a brief increase in water pressure, indicating to the driller that the inner tube assembly has landed in the bottom of the hole. This signal is needed in core drilling to notify the driller when drilling can start.

As described in for example in CA2254040, fluid pressure pushes a valve member that is connected to a retracting case, through a bushing at an increased fluid pressure. However, in such prior art systems, the time the inner tube assembly takes to travel from the surface to the bottom of the hole is not productive and is increased due to the latches dragging against the inner wall of the drill string. Existing solutions also have reduced fluid flow due to the limited travel of the retracting case and by using the same ports for landing indication and drilling fluid flow.

Consequently, there is still presently a need for a valve assembly for a landing indicator system that offers better drilling fluid flow, while reducing drag of latches against the inner wall of drill strings.

SUMMARY OF THE INVENTION

It is an object of the present invention to provide a valve assembly that addresses at least one of the above-mentioned needs.

Accordingly, the present invention provides a core barrel head assembly positionable within a drill string of a drilling apparatus, the core barrel head assembly comprising:

- an inner tube assembly;
- an inner tube member, disposed within the inner tube assembly and axially displaceable with respect to the inner tube assembly, the inner tube member comprising:
  - a landing shoulder;
  - at least one upstream fluid flow port positionable within a fluid line of the drilling apparatus upstream of the landing shoulder;
  - at least one downstream fluid flow port positionable within the fluid line of the drilling apparatus downstream of the landing shoulder;
  - at least one fluid pressure communication port positionable within the fluid line of the drilling apparatus;
  - an annular element positioned within the inner tube member;
  - a piston member mounted for axial movement within the inner tube member, traversable through the annular element and cooperable therewith to be configured by default to sealingly engage the annular element;
  - a valve member mounted for axial movement within a central bore of the inner tube member, the valve member positionable between a blocking position for blocking fluid flow between the upstream fluid flow port and the central bore and an unblocking position for allowing fluid flow between the upstream fluid flow port and the central bore, wherein the valve member is axially connected to the piston member;
  - a latching mechanism lockingly positionable between a latched configuration and an unlatched configuration;
  - a retracting case mounted for axial movement about the inner tube member, axial displacement of the retracting case being driven by a corresponding axial displacement of the piston member, the retracting case cooperating with the latching mechanism, such that the latching mechanism remains in a locked unlatched configuration for reducing drag of the latching mechanism on the drill string, wherein, upon the fluid pressure reaching said predetermined value through the at least one pressure communication port, said fluid pressure urges the piston member to traverse the annular member, thereby displacing the valve member from the blocking position to the unblocking position, and thereby allowing the latching mechanism to be positioned in the latched configuration.

According to the present invention, there is also provided a core barrel head assembly positionable within a drill string of a drilling apparatus, the core barrel head assembly comprising:

an inner tube assembly;

an inner tube member, disposed within the inner tube assembly and axially displaceable with respect to the inner tube assembly, the inner tube member comprising:

a landing shoulder;

at least one upstream fluid flow port positionable within a fluid line of the drilling apparatus upstream of the landing shoulder and in fluid communication with a central bore formed in the inner tube member;

at least one downstream fluid flow port positionable within the fluid line of the drilling apparatus downstream of the landing shoulder;

at least one fluid pressure communication port positionable within the fluid line of the drilling apparatus;

an annular element positioned within the inner tube member;

a piston member mounted for axial movement within the inner tube member, traversable through the annular element and cooperable therewith to be configured by default to sealingly engage the annular element in sealed engagement when subjected to a fluid pressure under a predetermined value;

a latching mechanism lockingly positionable between a latched configuration and an unlatched configuration;

a retracting case mounted for axial movement about the inner tube member, axial displacement of the retracting case being driven by a corresponding axial displacement of the piston member, the retracting case cooperating with the latching mechanism, such that the latching mechanism remains in a locked unlatched configuration for reducing drag of the latching mechanism on the drill string, the retracting case further comprising a valve member positionable between a blocking position for blocking fluid flow between the upstream fluid flow port and the central bore and an unblocking position for allowing fluid flow between the upstream fluid flow port and the central bore;

wherein, upon the fluid pressure reaching said predetermined value through the at least one pressure port, said fluid pressure urges the piston member to traverse the annular member, thereby displacing the valve member of the retracting case from the blocking position to the unblocking position, and thereby allowing the latching mechanism to be positioned in a locked latched configuration.

The piston member according to the present invention is located between a fluid pressure communication port and a fluid flow port upstream of the landing shoulder to hold the retracting case in an up position and the latches retracted. After an increased fluid pressure has pushed the piston member past the annular element or bushing, the piston member substantially restricts fluid flow through the bushing and allows the retracting case to move to a down position and extend the latches. If the latches are not extended due to obstruction or misalignment, the retracting case will prevent the piston member from completely passing through the bushing, thus maintaining high fluid pressure due to the flow ports remaining closed, and indicating to the driller that the latches have not properly latched. The present invention also results in reduced wear of the annular element as drilling fluid bypasses the annular element.

According to the present invention, there is also provided a core barrel head assembly positionable within a drill string of a drilling apparatus, the core barrel head assembly comprising:

an inner tube assembly;

an inner tube member, disposed within the inner tube assembly and axially displaceable with respect to the inner tube assembly, the inner tube member comprising:

a landing shoulder;

a piston member mounted for axial movement within the inner tube member;

a latching mechanism lockingly positionable between a latched configuration and an unlatched configuration; and a retracting case mounted for axial movement about the inner tube member, axial displacement of the retracting case being driven by a corresponding axial displacement of the piston member, the retracting case cooperating with the latching mechanism;

wherein the piston member comprises:

a slotted aperture;

a linking member slideable within the slotted aperture and connected to the retracting case; and a biasing element for urging the linking member towards abutted engagement with an extremity of the slotted aperture within the piston member and for absorbing momentum of the core barrel head assembly upon landing thereof.

BRIEF DESCRIPTION OF THE DRAWINGS

The foregoing summary, as well as the detailed description of the preferred embodiments of the present invention, will be better understood when read in conjunction with the appended drawing. For the purpose of illustrating the invention, there is shown in the drawing, which is diagrammatic, an embodiment that is presently preferred. It should be understood, however, that the present invention is not limited to the precise arrangements and instrumentalities shown. In the drawing.

PREFERRED EMBODIMENTS OF THE PRESENT INVENTION

Figure 1:
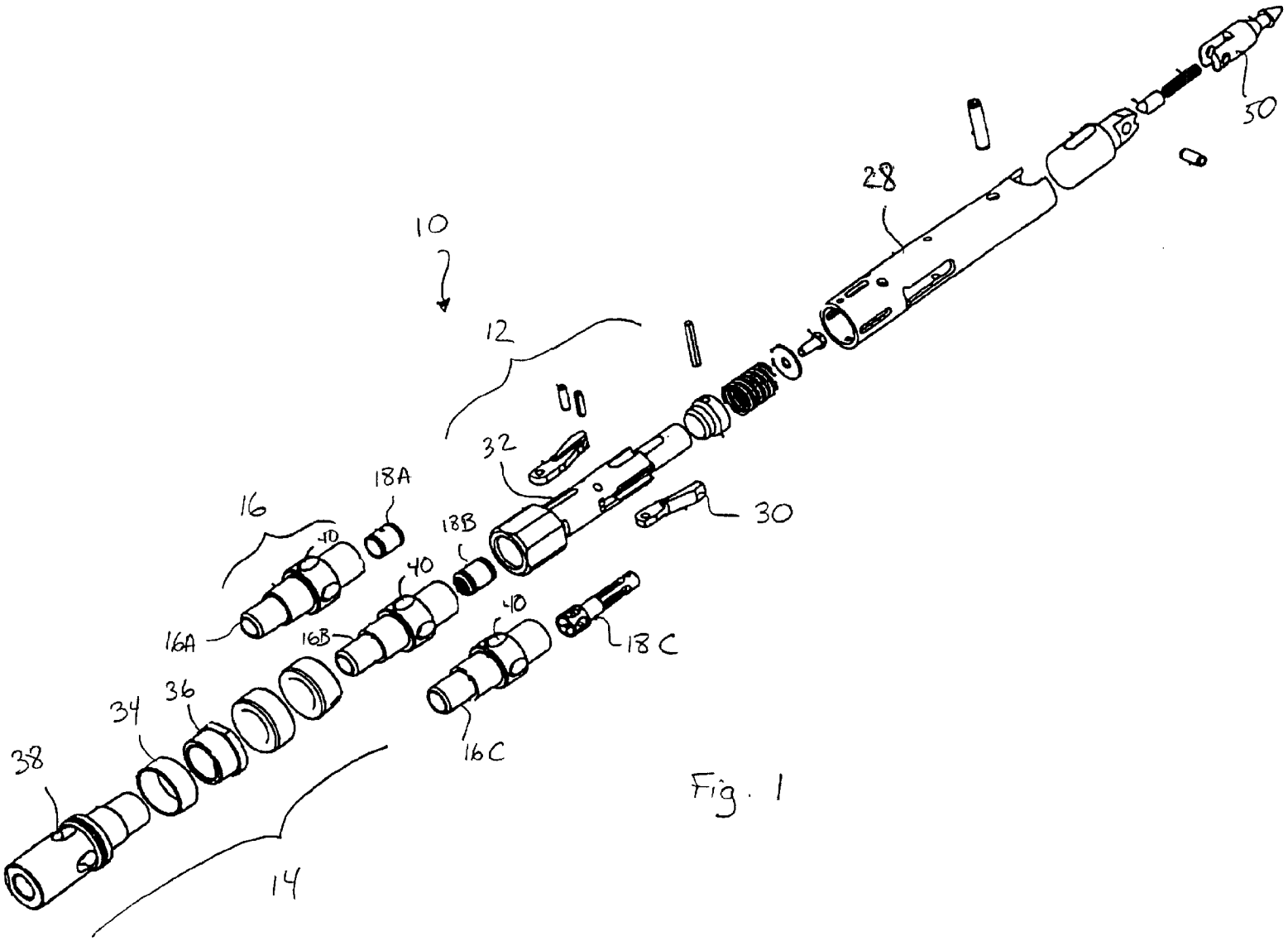
FIG. 1 is an exploded view of a head assembly according to a preferred embodiment of the present invention, with interchangeable mid latch bodies.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. The terminology includes the words specifically mentioned above, derivatives thereof, and words or similar import.

Referring now to the drawings in detail, wherein like numbers are used to indicate like elements throughout, there is shown in FIG. 1 an exploded view of a presently preferred embodiment of an core barrel head assembly 10 for a drilling apparatus.

The core barrel head assembly 10 is positionable within a drill string of a drilling apparatus. The core barrel head assembly 10 comprises an upper latch body 12 and a lower latch body 14. The head assembly 10 further comprises a mid latch body 16 separating the upper latch body 12 from the lower latch body 14 and removably coupling the upper latch body 12 to the lower latch body 14. FIG. 1 shows three different sample embodiments of the mid latch body 16A, 16B, 16C to illustrate the interchangeability of the mid latch body 16. In all cases, the mid latch body 16 is removably coupled to the upper latch body 12 and the lower latch body 14. The mid latch body 16 houses a landing indicator device 18. A common central bore 20 is formed by the upper latch body 12, the lower latch body 14 and the mid latch body 16.

Preferably, as illustrated in FIG. 1, the head assembly includes an upper latch body 12 with a latching assembly 30 and fluid pressure communication ports 32. The lower latch body 14 holds a landing shoulder 34 by a removable sleeve 36 and includes fluid flow ports 38 downstream of the landing shoulder. The mid latch body component 16 also has fluid flow ports 40 upstream of the landing shoulder, and connects the upper and lower latch bodies, 12,14, with a central bore 20 connecting the fluid flow ports 38,40. The mid latch body 16 contains a valving mechanism 42 which can provide a landing indication signal. The common central bore 20 is present through all body components. The head assembly preferably includes of two sets of ports: the first set for fluid pressure communication with the internal valving mechanism 42, the second set for fluid flow required for drilling in which the fluid flow is blocked or opened by the internal valving mechanism 42. This fluid port design offers the advantages of increased fluid flow during drilling which means it is less likely to collect debris and pack with mud and thus results also in a more efficient pumping system, compared to a head assembly where all the fluid circulates through a single port system upstream of the landing shoulder (thus more subject to blockage) from the upper latch body to the lower latch body, with no bypass port. Given the reconfigurable nature of the head assembly, different valving systems can be used depending on drilling conditions and also can be easily upgraded when a newer type of valve is developed. FIG. 1 illustrates an example of three different head assemblies in which the upper 12 and lower 14 latch bodies are similar and could be shared, but where a change-out of the mid latch body 16 allows the use of different valving mechanism designs that can be tailored to a specific drilling condition.

The following section illustrates an embodiment of a valving mechanism that can be changed out through replacement of the mid latch body 16 while also benefiting from the advantages of having the distinct fluid pressure communication ports 32 and fluid flow ports 40 upstream of the landing shoulder.

Timed Signal Valve

Referring now to the drawings, there is shown in FIG. 2A to 3C a first preferred embodiment of a valve assembly 100 for use in an inner tube member 112 of a core barrel head assembly positionable within a drill string of a drilling apparatus. The valve assembly 100 comprises at least one pressure port 32 formed in a sidewall of the inner tube member 112. There is also at least one fluid flow port 40 formed in the sidewall of the inner tube member 112.

Preferably, in a first descent configuration, a pressure piston member 118 is positioned on top of an annular element, preferably a bushing 120, wherein the piston member 118 and bushing 120 are in sealed engagement. The piston member 118 is preferably held in place by a compression spring 124 that is acting on a latch piston 126 that is connected to a retracting case 28 through a pin 127. The retracting case 28 serves as a linkage element between the latch piston 126 and the piston member 118, as it is connected to the piston member through another pin 129 that traverses the upper latch body 12 through a slot. A valve member 130 blocks the fluid flow ports 40 of the mid latch body 16. Preferably, seal members or O-rings 134 on the valve member 130 ensure proper sealing of the flow ports 40. The valve member 130 is connected to the pressure piston member 118 by a connecting rod 136. The pressure piston member 118 is connected directly to the retracting case 28 or has a limited movement connection with the retracting case 28, holding it in a middle, latch-retracted position, allowing the inner tube member 12 to travel in the drill string at an increased rate due to a reduction in the drag of the latches on the inside wall of the drill string, thus also reducing wear of the latches. As described above, the interaction between the pins 127,129 and the slots in the upper latch body 12 and slots in the retracting case 28 can help provide the limited movement connection of the piston member 118 with respect to any movement of the retracting case.

Figures 2A, 2B, 2C:
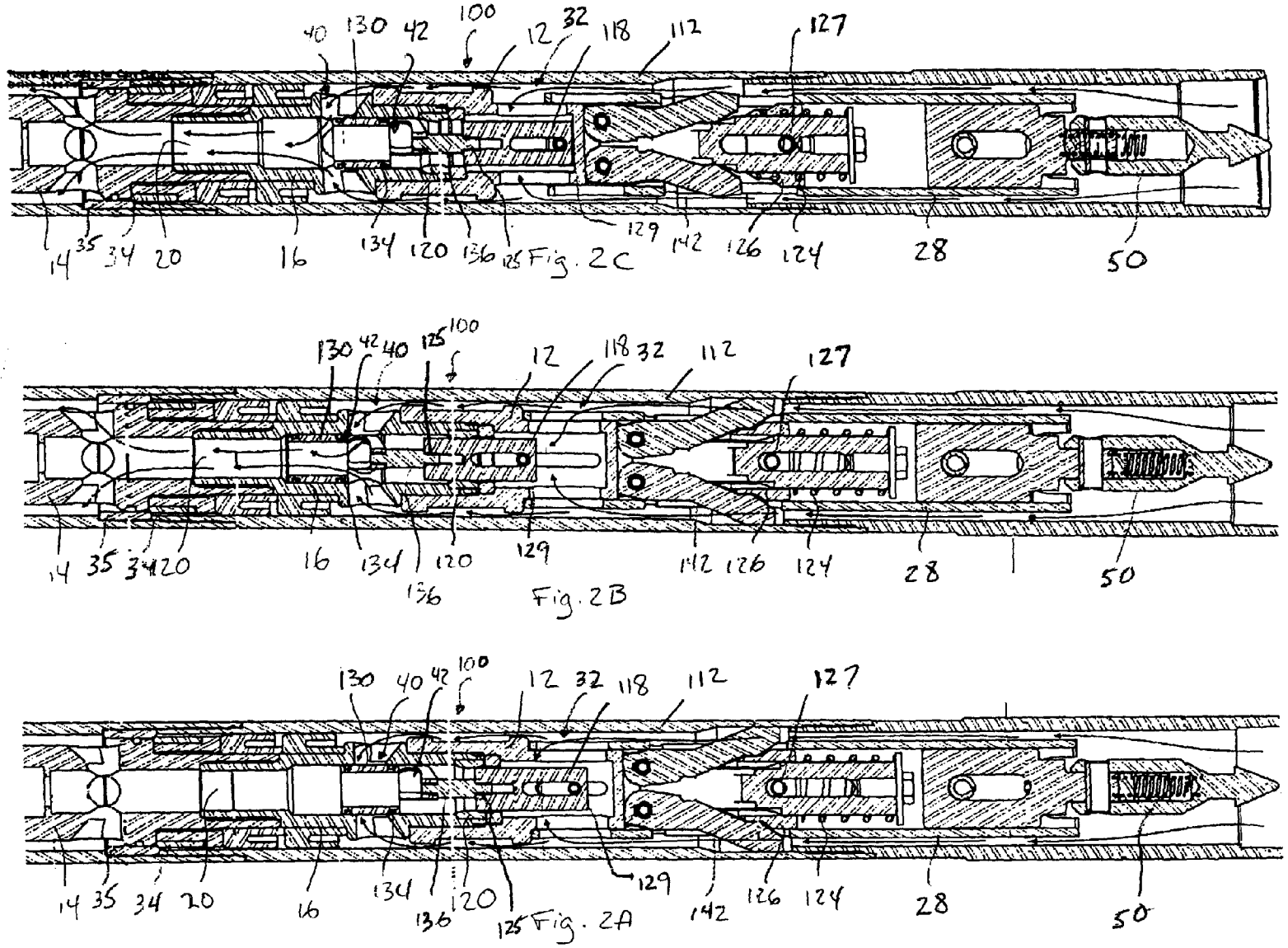
FIGS. 2A to 2C are cross-sectional side views of a head assembly according to another preferred embodiment of the present invention.
Figure 3A:
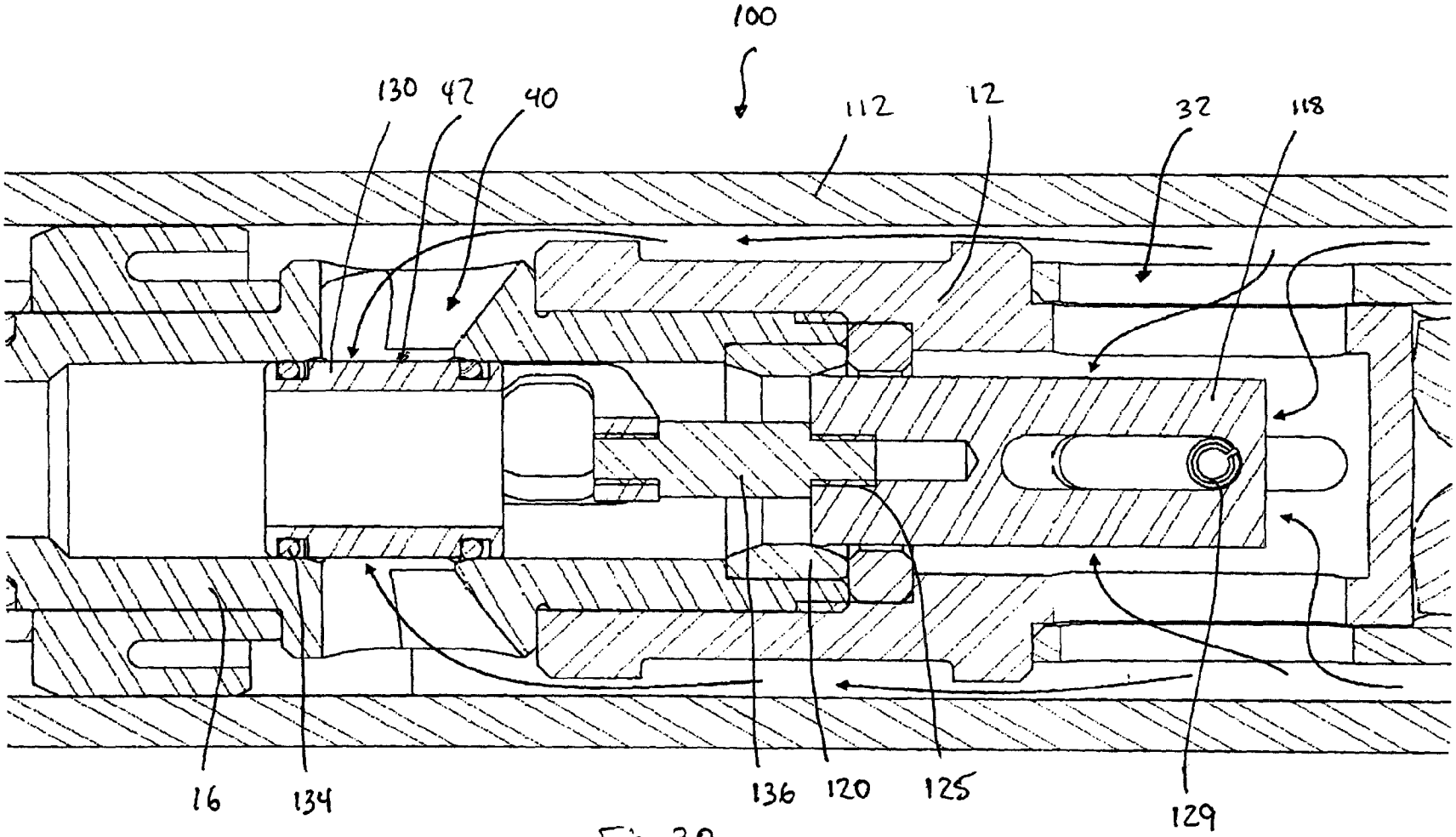
FIGS. 3A to 3C are detailed cross-sectional side views of the head assembly corresponding to the views shown in FIGS. 2A to 2C, illustrating flow streamlines through the valve assembly.

Preferably, as shown in FIGS. 2A and 3A, when the inner tube member 112 reaches the end of the drill string, a landing shoulder 34 will create a seal with the landing ring 35. This seal will build up the water pressure in the drill string. The valve member 130 blocks flow through the flow port 40 and the common bore 20 towards the lower latch body 14. This built-up pressure is transferred to the pressure piston member 118 through the pressure communication port 32. At a predetermined pressure, the force acting on the pressure piston member 118 will be great enough to push the piston member 118 through the bushing 120 and moving the head assembly into its second, drilling position. The increased pressure acts as a signal to the driller that the assembly has reached the end of the drill string and the latches 142 have extended to lock the head assembly into place. The interaction and relative displacement between the piston member 118 and the annular element or bushing 120 can help provide to the operator a pressure signal for a significant length of time.

Figure 3B:
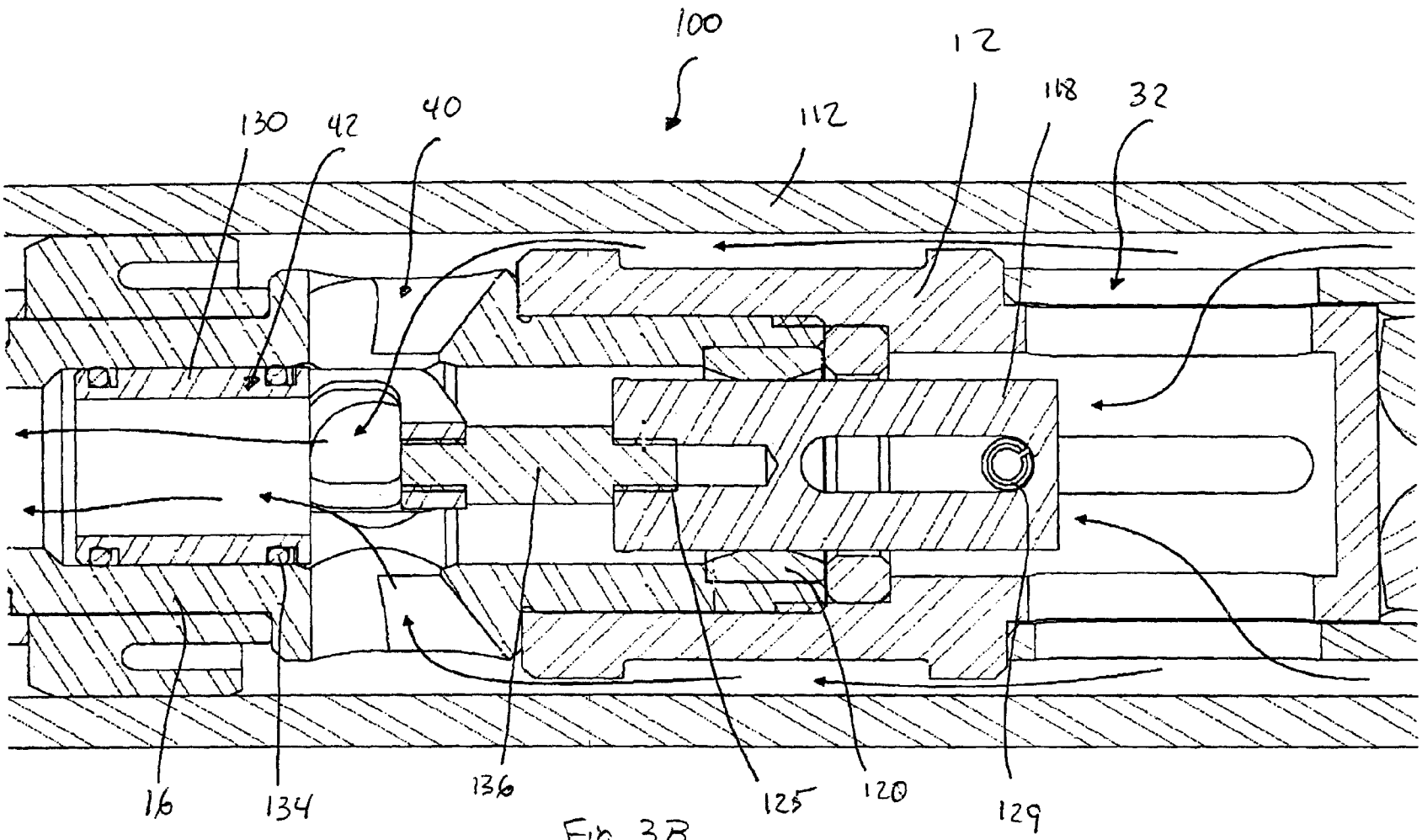

As shown in FIGS. 2B and 3B, when the piston member 118 has moved below and further past the bushing 120, the valve member 130 is also moved down to open the fluid flow ports 40 for drilling. The retracting case 28 is also moved to a lower, latched-extended position. This position can only be achieved when the latches 142 are able to fully extend, in a latched configuration, as the latches will keep the latch piston 126 from moving to the proper locked position (through the interaction between the pin 127 and the corresponding slot in the retracting case 28) if the landing position is incorrect.

Figure 3C:
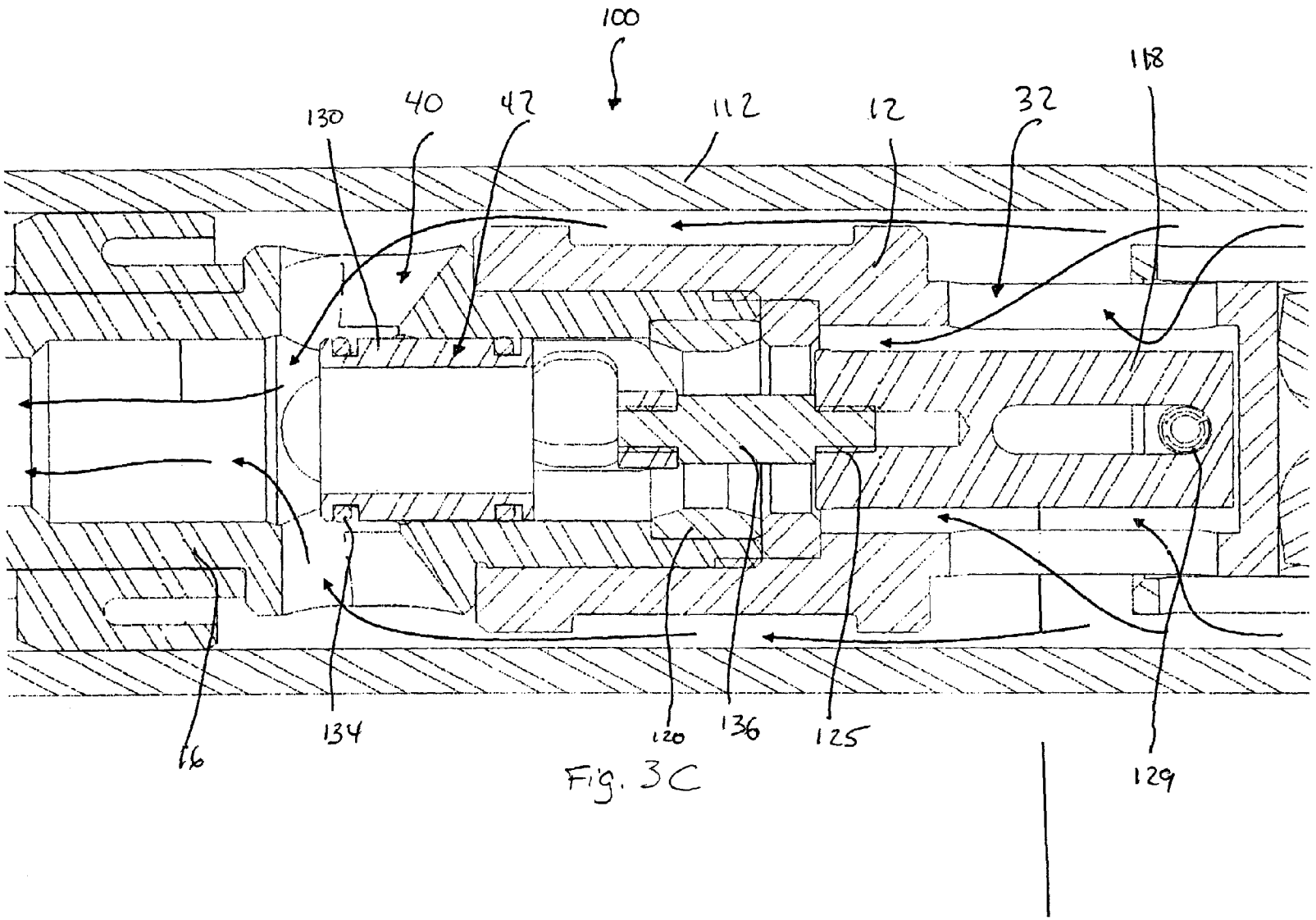

Continuing the operation of the valve assembly, a retrieval device can be preferably latched onto a spearhead 50 when the inner tube member 112 is ready to be brought back to the surface. The spearhead 50 is connected to the retracting case 28. When pulled by the retrieval device, the spearhead 50 will unlock the latches 142 and the assembly will be in a third, retrieval, position as shown in FIGS. 2C and 3C. This movement of the retracting case 28 also moves the pressure piston member 118 back on top of the bushing 120 and moves the valve member 130 back, past the drilling fluid flow ports 40, leaving the flow ports 40 open slightly to allow fluid flow during retrieval. The pulling of the retrieval device moves the assembly from the second position to the third position.

When the retrieval device is removed from the spearhead 50, the compression spring 124 will automatically reset the system and move the valve assembly components to their first, descent position. Ports in the assembly although shown as being radial in the figures an also be axial in direction.

Alternatively, in another embodiment of the present invention, the valve member 130 used to open and close the flow ports 40 may be part of the retracting case 28.

Another embodiment based on the valve assembly shown in FIGS. 2A to 3C, can also be provided. As mentioned above, the valving assembly comprises a piston member 118 mounted for axial movement within the mid latch body 16. A valve member 130 is mounted for axial movement within a central bore 20 of the mid latch body 16. First biasing means can be provided to urge the valve member 130 towards a blocking position for blocking fluid flow between the fluid flow port 40 and the central bore 20. Second biasing means (not shown) urge the piston member 118 away from the flow port 40, the second biasing means having a biasing force greater than the first biasing means. Releasable locking means 125 are provided for releasably locking the piston member 118 to the valve member 130 when the piston member 118 is in proximate engagement with the valve member 130.

Upon alignment of the at least one pressure communication port 32 with at least one aperture or port of an external port blocking structure, fluid pressure of a predetermined value through the at least one pressure communication port 32 urges the piston member 118 towards lockable engagement with the valve member 130. Upon reduction of the fluid pressure below the predetermined value, the second biasing means overcomes the first biasing means and urges the valve member 130 away from the blocking position and allows circulation of fluid flow between the fluid flow port 40 and the central bore 20.

The valving assembly illustrated in the preferred embodiment shown in FIG. 2A to 3C consists of separate pressure communication ports 32 and fluid flow ports 40. Such a design eliminates fluid flow obstructions and limitations with using a single set of ports for both fluid pressure signals and fluid flow upstream of the landing shoulder, as is the case in current and past designs known in the art. Preferably, the fluid flow ports 40 are downstream from the pressure communication ports 32. The fluid flow ports 40, are blocked by the valve member 130, preferably a valve spool or similar valve element, in the initial first blocking position. The valve spool 130 is releasably connectable to the piston member 118, with the ability to lock to the piston member 118 at a predetermined position. Relative motion between the valve spool 130 and piston member 118 is biased to the closed position by the first and second biasing means, a weak spring and a strong spring respectively. This slideable connection is lockable at a certain position and is manually or automatically unlockable. Increased fluid pressure is communicated via the pressure communication ports 32 to the piston member 118 and acts to compress the strong spring. As pressure increases, the force on the piston member 118 increases, compressing the strong spring. At a predetermined pressure, the piston member 118 will have moved a predetermined distance depending on the spring force. At this distance, the piston member 118 will lock onto the valve spool 130. This can be achieved in any way, including a ball lock, lock finger, cam and pin, profiled slot and pin, the preferred method being a ball lock to lock pin. At this point, the driller or the computerized drill will notice the increased fluid pressure and will release the pumping pressure. When this is done, the strong spring will overcome the remaining hydrostatic pressure and move the piston member 118 to its original position. The valve spool 130 which is now locked onto the piston member 118 is also moved with the piston member 118, opening the fluid flow port 40, allowing drilling fluid, such as water, to flow for drilling.

When the head assembly 10 is brought back to the surface, the valve spool 130 may be automatically or manually unlocked from the piston member 118, closing the port 40 and ready to be dropped back down the hole. Resetting of the valve may occur during ascent and retrieval, at the surface, or during unlatching and landing. A separate port or the same port may be opened to allow fluid flow during retrieval to avoid lifting the water column.

Preferably, the valve spool 130 may also be unlocked manually using a button, a twist lock, a pin or any other device or mechanism to unlock the spool from the piston. The weak spring will move the valve spool 130 to the blocked position when the valving mechanism is reset.

Preferably, to provide a substantial seal and to block fluid flow when desired, the valve spool 130 may contain some sort of sealing member or device such as an o-ring or gasket 134.

Preferably, to make the system operational at different depths and water pressures, the springs may be changed with different spring rates (or adjusted through adjustment mechanisms to match the drilling condition.) The piston diameter and/or surfaces areas may also be changed to the same effect.

Preferably, the valving assembly 100 may be an integral part of the mid latch body or constructed as a separate removable and/or replaceable assembly. Alternatively, the valve can block or open, to allow fluid flow, any of the following locations: below the fluid flow ports, at the central bore and above the fluid flow ports.

Figure 4:
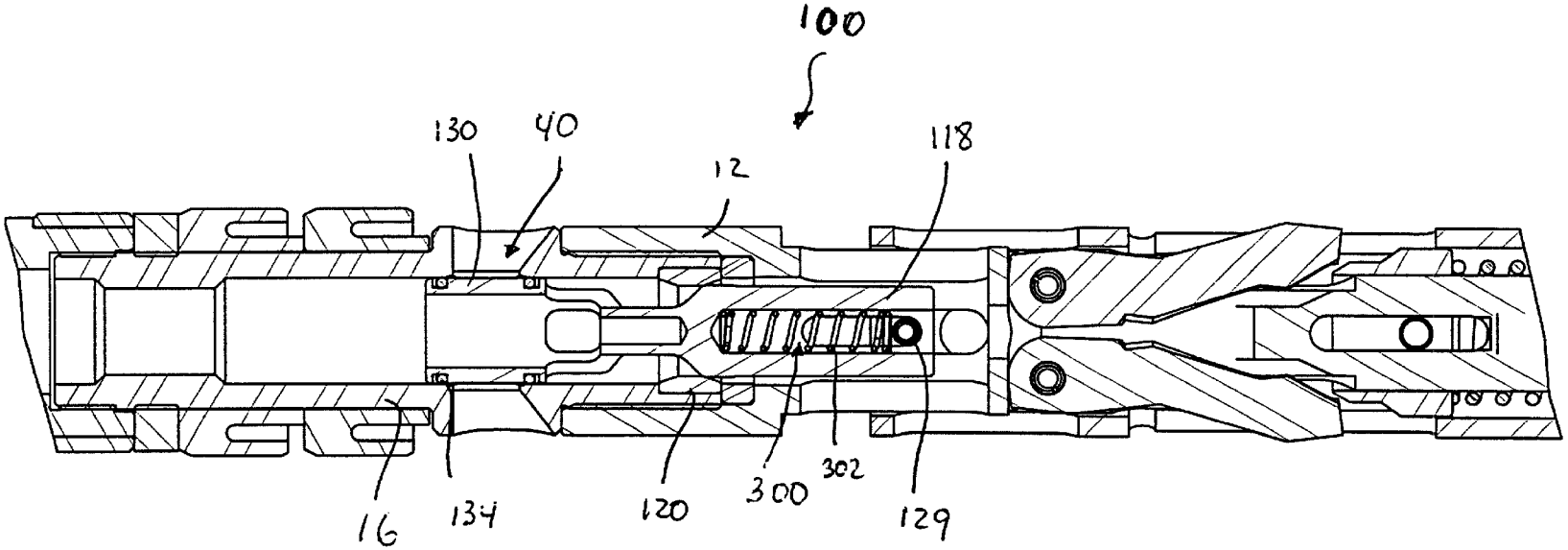
FIG. 4 is a detailed cross-sectional side view of an inner tube member of another preferred embodiment of the present invention.

Another aspect of the present invention is to provide a mechanism that can help absorb momentum of the head assembly upon landing thereof. Such a mechanism is illustrated in FIG. 4. In this embodiment of the present invention, the piston member 118 comprises a slotted aperture 300, and a linking member, such as a pin 129, slideable within the slotted aperture 300 and connected to the retracting case 28. A biasing element 302, such as a spring or any other mechanical equivalent, urges the linking member 129 towards abutted engagement with an extremity of the slotted aperture 300 within the piston member 119 and for absorbing momentum of the core barrel head assembly upon landing of the landing shoulder with a corresponding structure of the inner tube assembly. As it can be seen from the figure, the biasing element 302 will more specifically absorb the momentum of the linking member or pin 129 that is linked to the retracting case 28, as the pin attempts to slide within the slotted aperture 300 upon landing, but is restrained by the biasing element.

Although preferred embodiments of the present invention have been described in detail herein and illustrated in the accompanying drawing, it is to be understood that the invention is not limited to these precise embodiments and that various changes and modifications may be effected therein without departing from the scope of the present invention.

The invention claimed is:

1. A core barrel head assembly positionable within a drill string of a drilling apparatus, the core barrel head assembly comprising:

an inner tube assembly; and an inner tube member, disposed within the inner tube assembly and axially displaceable with respect to the inner tube assembly, the inner tube member comprising:

a landing shoulder;

at least one upstream fluid flow port positionable within a fluid line of the drilling apparatus upstream of the landing shoulder;

at least one downstream fluid flow port positionable within the fluid line of the drilling apparatus downstream of the landing shoulder;

at least one fluid pressure communication port positionable within the fluid line of the drilling apparatus;

an annular element positioned within the inner tube member;

a piston member mounted for axial movement within the inner tube member, traversable through the annular element and cooperable therewith to be configured by default to sealingly engage the annular element;

a valve member mounted for axial movement within a central bore of the inner tube member, the valve member positionable between a blocking position for blocking fluid flow between the upstream fluid flow port and the central bore and an unblocking position for allowing fluid flow between the upstream fluid flow port and the central bore, wherein the valve member is axially connected to the piston member;

a latching mechanism lockingly positionable between a latched configuration and an unlatched configuration; and a retracting case mounted for axial movement about the inner tube member, axial displacement of the retracting case being driven by a corresponding axial displacement of the piston member, the retracting case cooperating with the latching mechanism, such that the latching mechanism remains in a locked unlatched configuration for reducing drag of the latching mechanism on the drill string, wherein, upon the fluid pressure reaching said predetermined value through the at least one pressure communication port, said fluid pressure urges the piston member to traverse the annular member, thereby displacing the valve member from the blocking position to the unblocking position, and thereby allowing the latching mechanism to be positioned in a locked latched configuration.

2. The core barrel head assembly according to claim 1, wherein the valve member and piston member are integral to each other.

3. The core barrel head assembly according to claim 1, further comprising a connecting rod axially connecting the piston member to the valve member.

4. The core barrel head assembly according to claim 1, wherein the annular member is at least one of a gasket and a O-Ring.

5. The core barrel head assembly according to claim 1, further comprising:

a seal member surrounding the valve member.

6. The core barrel head assembly according to claim 1, wherein the predetermined value of fluid pressure is selected to correspond to a built up fluid pressure when the inner tube member reaches an end of the drill string.

7. The core barrel head assembly according to claim 1, wherein upon at least one of an obstruction and a misalignment of the inner tube member maintaining the latching mechanism in the unlatched configuration, the retracting case, cooperating with said latching mechanism, prevents the piston member from disengaging from the annular member.

8. The core barrel head assembly according to claim 1, further comprising:

a spearhead connected to the retracting case, wherein a retrieval force exerted on the spearhead pulls the retracting case, thereby urging the latching mechanism towards an unlatched configuration, urging the piston member towards sealed engagement with the annular member, past the annular member thereafter and urging the valve member towards a position partially blocking the at least one fluid flow port.

9. The core barrel head assembly according to claim 1, wherein the piston member comprises:

a slotted aperture;

a linking member slideable within the slotted aperture and connected to the retracting case; and a biasing element for urging the linking member towards abutted engagement with an extremity of the slotted aperture within the piston member.

10. A core barrel head assembly positionable within a drill string of a drilling apparatus, the core barrel head assembly comprising:

an inner tube assembly; and an inner tube member, disposed within the inner tube assembly and axially displaceable with respect to the inner tube assembly, the inner tube member comprising:

a landing shoulder;

at least one upstream fluid flow port positionable within a fluid line of the drilling apparatus upstream of the landing shoulder and in fluid communication with a central bore formed in the inner tube member;

at least one downstream fluid flow port positionable within the fluid line of the drilling apparatus downstream of the landing shoulder;

at least one fluid pressure communication port positionable within the fluid line of the drilling apparatus;

an annular element positioned within the inner tube member;

a piston member mounted for axial movement within the inner tube member, traversable through the annular element and cooperable therewith to be configured by default to sealingly engage the annular element in sealed engagement when subjected to a fluid pressure under a predetermined value;

a latching mechanism lockingly positionable between a latched configuration and an unlatched configuration; and a retracting case mounted for axial movement about the inner tube member, axial displacement of the retracting case being driven by a corresponding axial displacement of the piston member, the retracting case cooperating with the latching mechanism, such that the latching mechanism remains in a locked unlatched configuration for reducing drag of the latching mechanism on the drill string, the retracting case further comprising a valve member positionable between a blocking position for blocking fluid flow between the upstream fluid flow port and the central bore and an unblocking position for allowing fluid flow between the upstream fluid flow port and the central bore;

wherein, upon the fluid pressure reaching said predetermined value through the at least one pressure port, said fluid pressure urges the piston member to traverse the annular member, thereby displacing the valve member of the retracting case from the blocking position to the unblocking position, and thereby allowing the latching mechanism to be positioned in the latched configuration.

11. The core barrel head assembly according to claim 10, wherein the annular member is at least one of a gasket and a O-Ring.

12. The core barrel head assembly according to claim 10, wherein the predetermined value of fluid pressure is selected to correspond to a built up fluid pressure when the inner tube member reaches an end of the drill string.

13. The core barrel head assembly according to claim 10, wherein upon at least one of an obstruction and a misalignment of the inner tube member maintaining the latching mechanism in the unlatched configuration, the retracting case, cooperating with said latching mechanism, prevents the piston member from disengaging from the annular member.

14. The core barrel head assembly according to claim 10, further comprising:

a spearhead connected to the retracting case, wherein a retrieval force exerted on the spearhead pulls the retracting case, thereby urging the latching mechanism towards an unlatched configuration, urging the piston member towards sealed engagement with the annular member and urging the valve member towards a position partially blocking the at least one fluid flow port.

15. A core barrel head assembly positionable within a drill string of a drilling apparatus, the core barrel head assembly comprising:

an inner tube assembly; and an inner tube member, disposed within the inner tube assembly and axially displaceable with respect to the inner tube assembly, the inner tube member comprising:

a landing shoulder;

a piston member mounted for axial movement within the inner tube member;

a latching mechanism lockingly positionable between a latched configuration and an unlatched configuration; and a retracting case mounted for axial movement about the inner tube member, axial displacement of the retracting case being driven by a corresponding axial displacement of the piston member, the retracting case cooperating with the latching mechanism;

wherein the piston member comprises:

a slotted aperture;

a linking member slideable within the slotted aperture and connected to the retracting case; and a biasing element for urging the linking member towards abutted engagement with an extremity of the slotted aperture within the piston member and for absorbing momentum of the core barrel head assembly upon landing thereof.

* * * * *